US006624565B2

(12) United States Patent
Topelberg

(10) Patent No.: US 6,624,565 B2
(45) Date of Patent: Sep. 23, 2003

(54) CELLULAR FLEXIBLE DISPLAY STRUCTURE

(75) Inventor: Rafael Topelberg, Ramat Gan (IL)

(73) Assignee: Visson IP, LLC, Dover, DE (US)

( * ) Notice: Subject to any disclaimer, the term of this patent is extended or adjusted under 35 U.S.C. 154(b) by 90 days.

(21) Appl. No.: 09/898,492

(22) Filed: Jul. 5, 2001

(65) Prior Publication Data

US 2003/0006693 A1 Jan. 9, 2003

(51) Int. Cl.[7] ..... H01J 1/62; H01J 63/04
(52) U.S. Cl. ..... 313/495; 313/498; 313/483
(58) Field of Search ..... 313/483, 498–512, 313/494–497

(56) References Cited

U.S. PATENT DOCUMENTS 3,278,784 A * 10/1966 Masaharu ..... 313/511
3,571,647 A 3/1971 Robinson
3,803,437 A 4/1974 Robinson
5,469,020 A * 11/1995 Herrick ..... 313/511
5,962,967 A 10/1999 Kiryuschev et al.
6,229,265 B1 * 5/2001 Schroeder-Perry et al. ..... 315/169.3
6,274,978 B1 * 8/2001 Roach et al. ..... 313/483
2002/0074937 A1 * 6/2002 Guberman et al. ..... 313/511

FOREIGN PATENT DOCUMENTS

JP 2001 34195 2/2001

* cited by examiner

*Primary Examiner*—Nimeshkumar D. Patel
*Assistant Examiner*—German Colón
(74) *Attorney, Agent, or Firm*—Browdy and Neimark, P.L.L.C.

(57) ABSTRACT

An electro-optical display comprising two sets of fibers, one of them including conductive wires, forming a flexible carrying network with cells, a layer of electro-optically active (EOA) substance filling the cells; a first transparent conductive layer covering one side of the carrying network in electric contact with the conductive wires; a second conductive layer covering the other side of the network and insulated from the conductive wires, thereby forming an electrooptically active zone between the fist conductive layer and the second conductive layer. The EOA substance and the second layer may be laid in spots forming display elements and pictures. The first conductive layer may be laid in separated strips parallel to the conductive wires while the second conductive layer may be laid in transverse strips, thereby forming a matrix of pixels defined between the overlapping strips.

18 Claims, 3 Drawing Sheets

CELLULAR FLEXIBLE DISPLAY STRUCTURE

FIELD OF THE INVENTION

This invention relates to flexible electro-optic displays, in particular to displays based on a structure built of flexible fibers.

BACKGROUND OF THE INVENTION

An electro-optic display is a device designed to change its optical state when some kind of electric or electromagnetic field is applied to it. A visible image on such displays is formed from a plurality of display elements including an electro-optically active (EOA) substances. The term "EOA substance" denotes any substance that changes its color, transparency, reflection or other optic properties, or capable of emitting light, when subjected to changes of electric or electromagnetic field, and thereby suitable for displaying images. Flexible electro-optic displays may be made of flexible polymer films, where the EOA substance and patterns of electrodes are laid in thin layers over a polymer substrate, or may be based on flexible fibers or strips woven or knitted into fabric or textile material where the electrodes are in the constituent fibers. Woven displays have certain advantages since they may be produced using known weaving techniques which do not limit their length. Woven displays are more flexible and robust than integral film displays.

U.S. Pat. No. 5,962,967 and JP 2001-034195 disclose woven displays made of two sets of transverse fibers including a longitudinal conductor and a coating of light-emitting or other EOA substance. An individually controllable display element (pixel) is formed at each junction where a fiber of one set overlaps a fiber of the other set. The visible images on such displays are formed from a plurality of pixels. Understandably, the optically active (luminous) zones in such pixels are of the size of the fiber diameter.

U.S. Pat. No. 3,803,437 discloses a display comprising a set of conductive wires interwoven with a transverse set of insulating fibers, and covered with a layer of phosphor. Electric voltage is applied between each two adjacent conductors and a continuous luminous surface is obtained, without display elements. In this structure, the space between the conductive wires must be of predetermined width depending on the nature of the phosphor.

U.S. Pat. No. 3,571,647 discloses a woven display comprising a carrying non-conductive fabric impregnated with a phosphor, a first (common) electrode in the form of a flexible conductive layer laid at the back of the fabric, and second electrodes in the form of insulated wires sewn into the fabric. The second electrodes may be sewn in various designs to form display elements of a static image or picture. The luminous zone of each element is in a narrow vicinity of the insulated wire stitches.

SUMMARY OF THE INVENTION

In accordance with the present invention, there is provided an electro-optical display comprising: a plurality of fibers, preferably woven or knitted, some of them including conductive wires. The fibers form a flexible carrying network with cells defined therebetween. A layer of EOA substance fills the cells, and a first conductive layer covers one side of the carrying network. This conductive layer is transparent or translucent and is in electric contact with the conductive wires. A second conductive layer covers the other side of the network but is insulated from the conductive wires. An electrooptically active zone (EOA zone) is formed between the first and the second conductive layer, where the conductive wires serve to power the first transparent conductive layer. The second conductive layer may be also transparent.

According to one embodiment of the present invention, the EOA substance is filling the carrying network cells in separated spots or in spots of different electro-optic properties. These spots constitute display elements that may be controlled en ensemble and thus form a so-called static visible image.

According to another embodiment of the present invention, the second conductive layer is laid on the network in separated spots, thereby dividing the EOA zone into individually controllable display elements. Thus a dynamic or animated visible image may be formed.

According to a further embodiment of the present invention, the fibers of the display are organized in two or more sets. The first set includes fibers with conductive wires which run generally parallel to each other. The first transparent conductive layer is laid in separated longitudinal strips parallel to the fibers of the first set. Each strip is in electric contact with one or more conductive wires of the first set, but each conductive wire is in contact with only one strip. The second conductive layer is laid in separated parallel strips transverse to the longitudinal strips, thereby forming a dynamic matrix of individually controllable display elements or pixels, each pixel being defined in the overlapping area between a longitudinal strip and a transverse strip. The EOA substance in each pixel may have different electro-optic properties. In this way, an RGB or CMYK color display may be particularly obtained.

According to a still further embodiment of the present invention, an electro-optical display may have in parts thereof a dynamic matrix of individually controllable pixels, in other parts thereof—dynamic or animated images, and in still other parts of the same display-static images.

According to a last embodiment of the present invention, an electro-optical display may comprise a plurality of fibers including longitudinal conductive elements arranged in a flexible carrying network, EOA substance filling the cells, and a conductive layer covering one side of the network and insulated from the conductive elements. In this case EOA zones are formed in "pockets" adjacent to the conductive elements and the conductive layer.

The electro optic displays of the present invention are based on a cellular network with conductive layers on both sides thereof which presents a robust and flexible structure reliably accommodating the EOA substance. In these displays, the entire mass of the EOA substance may be utilized for producing optical effects, and in one display, static pictures may be combined with dynamic images such as running text or animation. In woven displays using high voltage, such as electroluminescent (EL) displays, electric breakdowns arising from defects in coating layers of the conductive fibers may be avoided. Other important advantages of the present invention are that the carrying network structure may be produced by well known efficient weaving or knitting methods, the transparent conductive layer may be made of polymers of limited conductivity, and display elements of arbitrary shape and size or matrix pixels can be obtained by printing techniques.

BRIEF DESCRIPTION OF THE DRAWINGS

In order to understand the invention and to see how it may be carried out in practice, preferred embodiments will now be described, by way of non-limiting examples only, with reference to the accompanying drawings, in which.

DETAILED DESCRIPTION OF THE INVENTION

Figure 1:
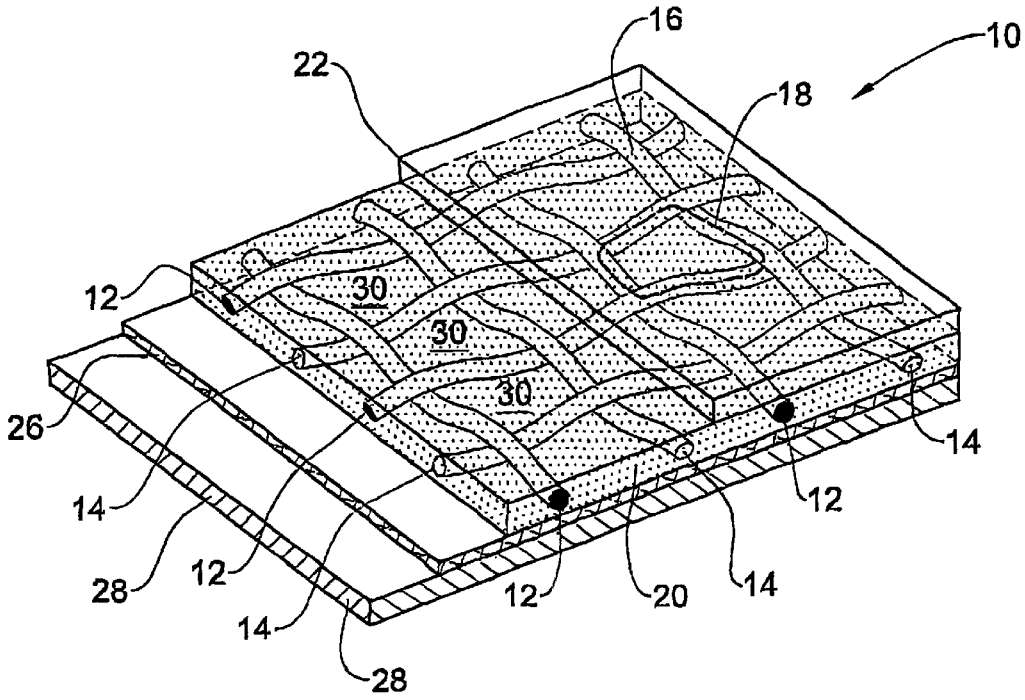
FIG. 1 is a perspective cut-out view of an electrooptic display structure in accordance with one embodiment the present invention.
Figure 2:
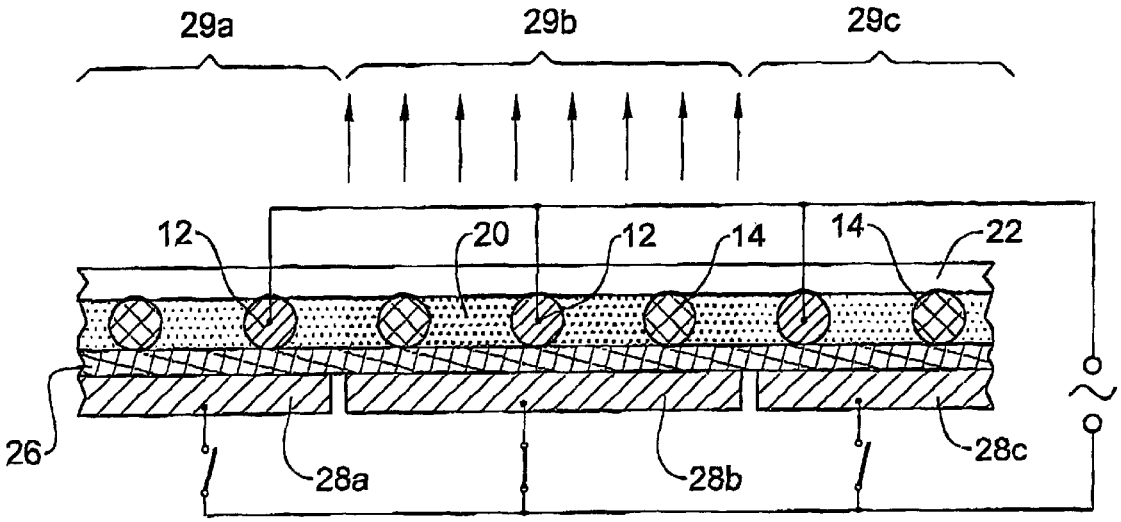
FIG. 2 is a schematic sectional view of the structure shown in FIG. 1.

With reference to FIGS. 1 and 2, an electro-optical display structure 10 comprises a plurality of conducive fibers (wires) 12 and non-conductive fibers 14. The fibers form a flexible carrying network 16, which may be woven or knitted, with cells 18 defined between fibers. A layer of electro-optically active (EOA) substance 20 is filling the cells 18. Without any limitation, the network in the figures is shown as orthogonal and the EOA substance is shown as electroluminescent (EL). A transparent or translucent conductive layer 22 is laid on one side of the carrying network, in electric contact with the wires 12. An insulation layer 26 covers the other side of the network 16, and a second conductive layer 28 covers the insulation layer 26. When an appropriate electric signal is applied to the conductive wires 12 and to the second conductive layer 28, an electrooptically active zone (EOA zone) 30 defined between the first conductive layer 22 and the second conductive layer 28 emits light.

It will be appreciated that in the case shown in FIG. 1, the EOA zone formed between the continuous conductive layers 22 and 28 will encompass the whole display. Such display will be a continuous luminous panel. In the case of woven EL displays using high voltage, the EOA zone formed between the conductive layers is less prone to electric breakdowns arising from defects in the coating layers of the conductive fibers than an EOA zone formed between transverse fibers known in the prior art.

Obviously, the EOA substance 20 may be laid in spots of different electro-optic properties (not shown), for example different colors, or in spots separated by spaces. Thus, the luminous panel may display a static image.

The second conductive layer 28 may be also laid in separated spots 28*a*, 28*b*, 28*c* as shown in FIG. 2, thereby forming display elements 29*a*, 29*b*, 29*c* which may be controlled individually via suitable wiring. In FIG. 2, the element 29*b* is lit while the elements 29*a* and 29*c* are not. Thus the luminous panel may display dynamic pictures and animation.

Figure 3A:
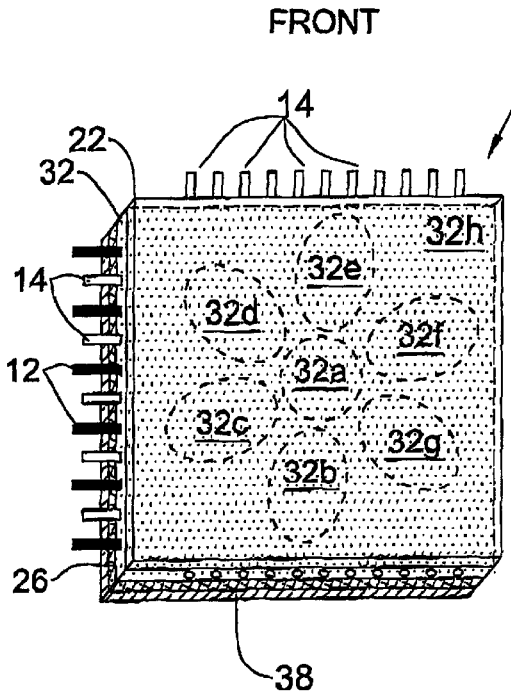
FIGS. 3A and 3B are front and back plan views of an animated display structure in accordance with another embodiment of the present invention.

An example of color animated picture is presented in FIGS. 3A (front view) and 3B (back view). A display structure 30 comprises a carrying network made of conductive wires 12 and non-conductive fibers 14 with cells therebetween, similar to the structure of FIG. 1. A layer of EOA substance 32 fills the cells but it is laid on the network in spots 32*a*, 32*b*, . . . , 32*h* of different color. A transparent conductive layer 22 is laid on the front side of the carrying network, in electric contact with the wires 12. An insulation layer 26 covers the back side of the network, and a second conductive layer 34 covers the insulation layer 26. The second conductive layer is not continuous as in FIG. 1 but is laid in spots 34*a*, 34*b*, . . . , 34*h* separated by gaps or insulation 36. The conductive spots 34 generally coincide, in plan view, with the respective EOA substance spots 32, thereby forming a display element with an EOA zone between each conductive spot 34 and the conductive layer 22. Using a suitable wiring and controller, the display elements may be switched on and off in a desired order. It should be understood that the display structure 30 will work also in the case when the boundaries of the spots of EOA substance 32 do not coincide with the boundaries of the spots of the second conductive layer 34.

Figure 4:
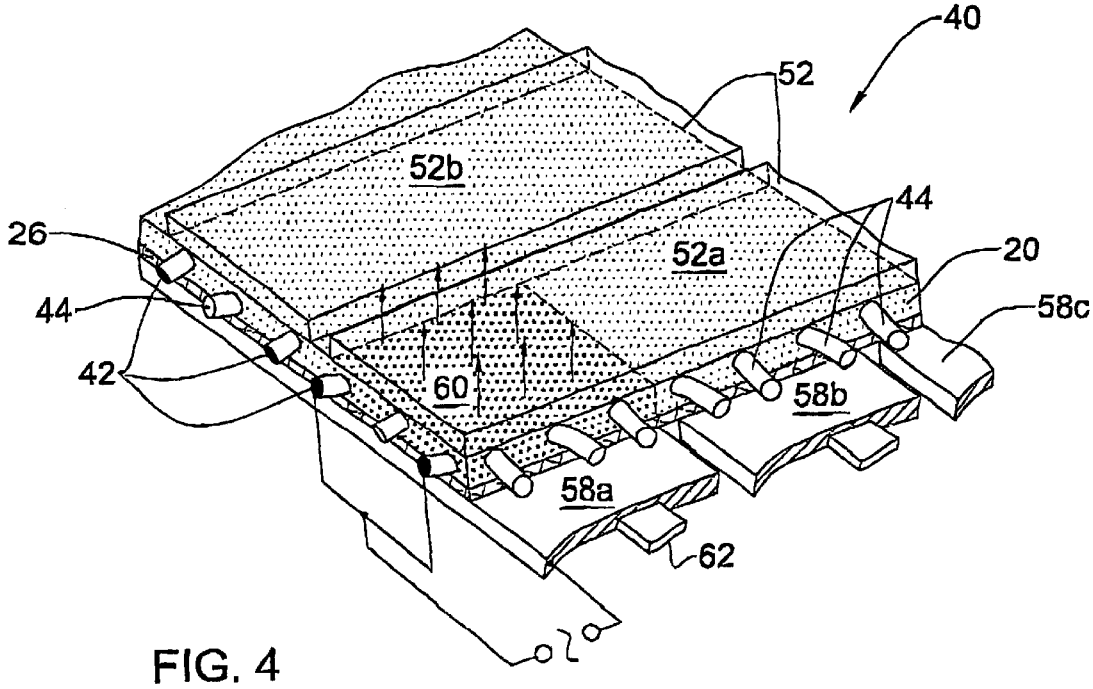
FIG. 4 is a perspective cut-out view of an electrooptic display structure in accordance with a further embodiment of the present invention.

With reference to FIG. 4, another embodiment of the present invention is presented as an electro-optical display structure 40 similar to the structure shown in FIG. 1 in that it is based on a flexible carrying network with cells, and has the same layer of EOA 20 filling the cells and an insulating layer 26 under the network. However, all conductive fibers (wires) 42 in this case are organized in one set of fibers running in one direction generally parallel to each other, while non-conductive fibers 44 may be both transverse and parallel to the conductive wires 42. A transparent conductive layer is laid on the structure 40 in separated longitudinal strips 52 parallel to the conductive wires 42. Each strip 52 is in electric contact with at least one conductive wire 42, while each conductive wire 42 is in contact with only one strip 52. Evidently, if a second, continuous conductive layer 28 were laid on the insulating layer 26 (as it is in FIG. 1), then an EOA zone would be obtained, consisting of a plurality of individually controllable strip display elements defined between the strips 52 and the second conductive layer 28 (not shown in FIG. 4).

In FIG. 4, the second conductive layer is shown laid on the insulation layer 26 in separated parallel strips 58 transverse to the longitudinal strips 52. Thereby a dynamic matrix of individually controllable pixels is formed. A pixel 60, for example, is defined in the overlapping area between a longitudinal strip 52*a* and a transverse strip 58*a*. The size of the obtained pixels is not limited by the fibers' diameter as in prior-art displays or by the network cell size. In fact, the carrying network determines only the thickness of the EOA layer which is commensurate with the fibers' diameter, while display elements of arbitrarily large size may be created by printing of the conductive layers in strips. The EOA substance in adjacent pixels may be of different kind, for example producing red, green and blue color, thereby forming a color display.

The second conductive layer 58 and the insulating layer 26 may be also transparent, in order to obtain, for example, a double-sided display. In this case, a better conductivity of the transverse strips 58*a*, 58*b*, etc. may be provided by printing narrow metallic conductive strips 62 in contact with strips 58.

Figure 3B:
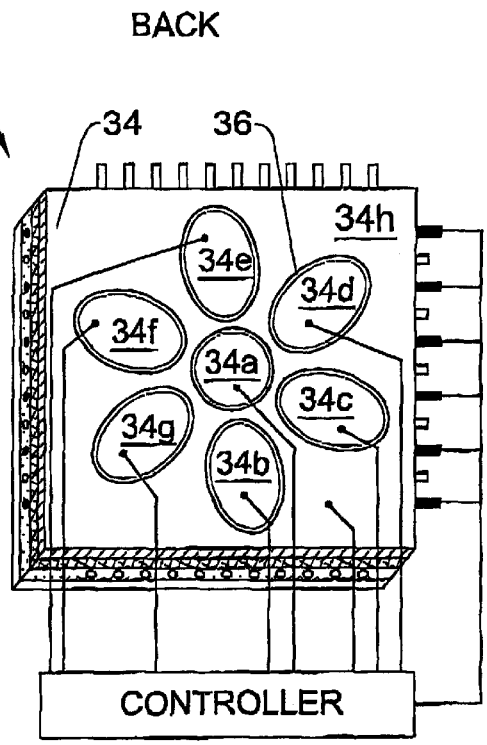
Figure 5A:
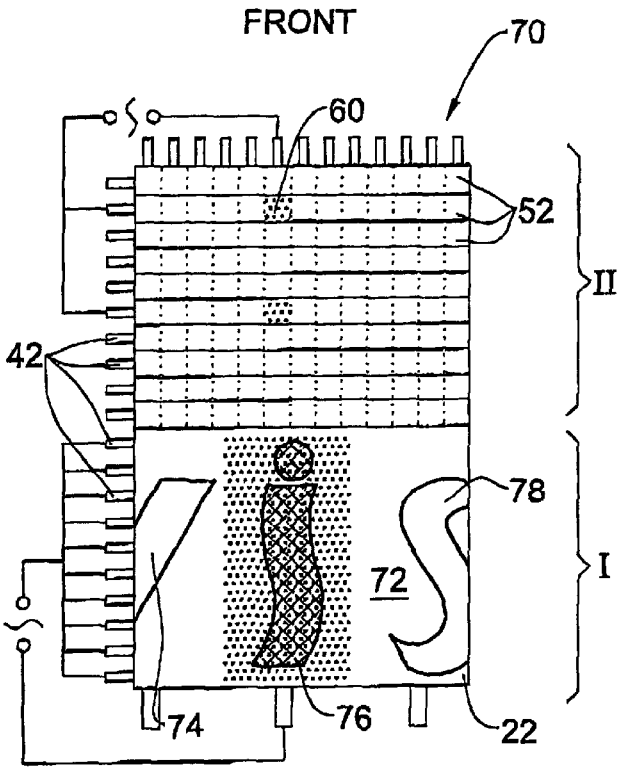
FIGS. 5A and 5B are front and back plan views of a combined electrooptic display structure in accordance with still further embodiment of the present invention.
Figure 5B:
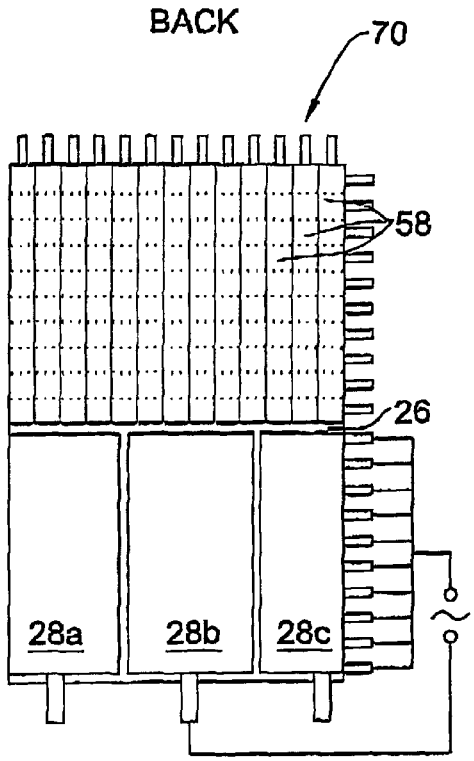

With reference to FIGS. 5A (front view) and 5B (back view), still another embodiment of the present invention is presented as a display structure 70 combining a static and a dynamic display in one unit. The combined display structure 70 comprises a carrying network having cells filled with EOA substance and conductive fibers 42 orientated in one direction. A transparent conductive layer 22 covers the front side of the network, an insulation layer 26 covers the back side of the network, and a second conductive layer 28 covers the insulation layer. The display structure 70 is divided into two or more areas of two kinds. The area I is organized in a manner similar to FIG. 3: a layer of EOA substance is laid in separated spots or in spots of different electrooptic properties 72, 74, 76, and 78. The transparent conductive layer 22 covers the area I as one continuous spot, while the second conductive layer is laid in separated spots 28*a*, 28*b*, 28*c*. Thereby, the area I constitutes a display with a number of static pictures.

The area II is organized in a manner similar to FIG. 4. A transparent conductive layer is laid in longitudinal strips 52 parallel to the conductive wires 42 and in electric contact with them. A second conductive layer is laid in strips 58 transverse to the longitudinal conductive strips 52. Thereby, a dynamic matrix of individually controllable pixels 60 is formed in the area II. The EOA substance in the area II may be uniform, yielding a monochromatic matrix display, or the pixels may have different colors, yielding a color display. Thus, one flexible display may contain both static pictures such as logos, decorative luminous panels, and dynamic images such as animation and/or running text.

Figure 6:
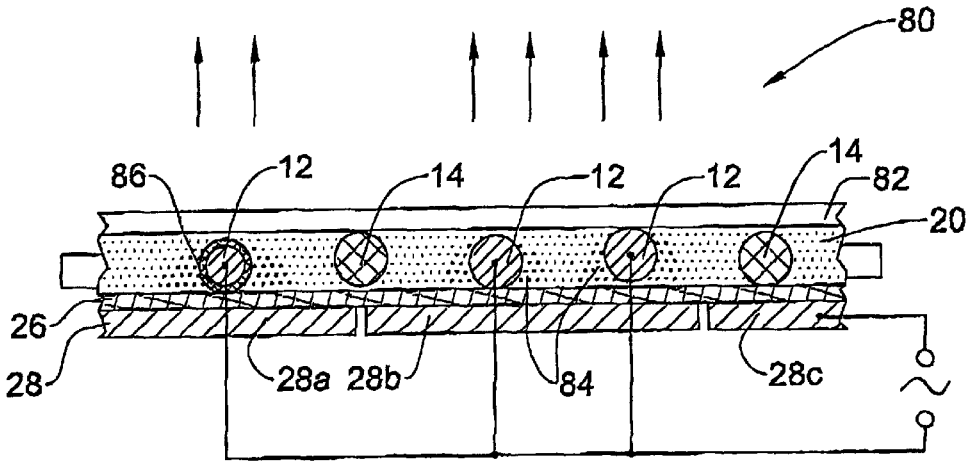
FIG. 6 is a schematic sectional view of a simplified display structure in accordance with another aspect of the invention.

A different aspect of the present invention is demonstrated in FIG. 6 which shows a sectional view of a display structure 80, simplified with respect to the structure of FIG. 1 in that it has no transparent conductive layer on the front side of the carrying network. It comprises a plurality of conductive fibers 12 and non-conductive fibers 14 forming a flexible carrying network with cells defined between the fibers. A layer of EOA substance 20 is filling the cells. The structure has an insulation layer 26 covering the back side of the network and a conductive layer 28 covering the insulation layer 26, which may be laid in spots 28*a*, 28*b*, 28*c*. The display may have an optional transparent layer 82 laid over the network to protect and/or seal the EOA layer. In this case EOA zones 84 are formed in "pockets" adjacent to the conductive fibers 12 and to the conductive layer 28. However, these EOA zones are smaller than the ones formed with the transparent conductive layer 22 of FIG. 1.

It will be appreciated that if the conductive fibers have each their own insulation layer (as shown under number 86 in FIG. 6), the structure may work without the insulation layer 26. Also, the display structures with a front transparent conductive layer shown in FIGS. 1 to 5 may be realized without such layer, as shown in FIG. 6.

Although a description of specific embodiments has been presented, it is contemplated that various changes could be made without deviating from the scope of the present invention.

What is claimed is:

1. An electro-optical display comprising: a plurality of fibers, at least a part of them including longitudinal conductive elements, said fibers forming a flexible carrying network with cells defined therebetween; a layer of electro-optically active (EOA) substance filling said cells; a first conductive layer covering said carrying network on one side thereof, said conductive layer being transparent or translucent and in electric contact with at least a part of said conductive elements; and a second conductive layer covering said network on the other side thereof and insulated from said conductive elements, thereby forming an electrooptically active zone (EOA zone) between said first conductive layer and said second conductive layer.

2. An electro-optical display according to claim 1, wherein said fibers are interlocked in woven or knitted arrangement.

3. An electro-optical display according to claim 1, wherein said second conductive layer is transparent or translucent.

4. An electro-optical display according to claim 1, wherein said EOA substance is filling the carrying network cells in separated spots or in spots of different electro-optic properties, said spots constituting display elements.

5. An electro-optical display according to claim 1, wherein said second conductive layer is laid in separated spots, thereby dividing said EOA zone into individually controllable display elements.

6. An electro-optical display according to claim 1, wherein said fibers are organized in at least two sets, the first set including at least the fibers with longitudinal conductive elements, the fibers of the first set being generally parallel to each other.

7. An electro-optical display according to claim 6, wherein said first transparent conductive layer is laid in separated longitudinal strips parallel to said fibers of the first set, each strip being in electric contact with at least one of the conductive elements in the first set, each of said conductive elements being in contact with only one of said strips, thereby dividing said EOA zone into a plurality of individually controllable strip display elements defined between said strips and said second conductive layer.

8. An electro-optical display according to claim 7, wherein said second conductive layer is laid in separated parallel strips transverse to said longitudinal strips, thereby forming a matrix of individually controllable display elements or pixels, each display element being defined in the overlapping area between a longitudinal strip and a transverse strip.

9. An electro-optical display according to claim 8, wherein said EOA substance is filling the carrying network cells in spots of different electro-optic properties, said spots generally coinciding with said pixels.

10. An electro-optical display according to claim 7, wherein said second conductive layer is laid over at least one part of said display in separated parallel strips transverse to said longitudinal strips, thereby forming a matrix of individually controllable display elements or pixels over said one part; and is laid over another part of said display in separated spots of arbitrary shape.

11. An electro-optical display according to claim 10, wherein said EOA substance, in said another part of the display, is filling the carrying network cells in separated spots or in spots of different electro-optic properties.

12. An electro-optical display according to claim 1, comprising a plurality of elongated conductive elements in contact with said second conductive layer, thereby enhancing the conductivity of the latter.

13. An electro-optical display according to claim 1, wherein said second conductive layer is insulated from said conductive elements by an insulation layer laid between said network and said second conductive layer.

14. An electro-optical display according to claim 1, wherein said second conductive layer is insulated from said conductive elements by insulation laid over each of said conductive elements.

15. An electro-optical display comprising: a plurality of fibers, at least a part of them including longitudinal conductive elements, said fibers forming a flexible carrying network with cells defined therebetween; a layer of electro-optically active (EOA) substance filling said cells; and a transparent or translucent conductive layer covering said network on one side thereof, said conductive elements being insulated from said conductive layer, thereby forming electrooptically active zones (EOA zones) adjacent to said conductive elements and said conductive layer.

16. An electro-optical display according to claim 15, wherein said fibers are interlocked in woven or knitted arrangement.

17. An electro-optical display according to claim 15, wherein said EOA substance is filling the carrying network cells in separated spots or in spots of different electro-optic properties, said spots constituting display elements.

18. An electro-optical display according to claim 15, wherein said conductive layer is laid on said carrying network in separated spots, thereby dividing said EOA zone into individually controllable display elements.

* * * * *